United States Patent [19]

Biles et al.

[11] 4,287,044

[45] Sep. 1, 1981

[54] SILVER RECOVERY APPARATUS

[75] Inventors: Don L. Biles, Chamblee; A. Alan Richardson, Lilburn, both of Ga.

[73] Assignee: Silver Systems, Ltd., Chamblee, Ga.

[21] Appl. No.: 135,674

[22] Filed: Mar. 31, 1980

[51] Int. Cl.[3] ..... C25C 7/06; C25C 1/20

[52] U.S. Cl. ..... 204/231; 204/109

[58] Field of Search ..... 204/228, 231, DIG. 9

[56] References Cited

U.S. PATENT DOCUMENTS

| | | | |
|---|---|---|---|
| 3,551,318 | 12/1970 | Snook | 204/228 |
| 3,616,412 | 10/1971 | Guage | 204/195 |
| 3,616,435 | 10/1971 | Favell | 204/228 |
| 3,658,683 | 4/1972 | Lagier | 204/272 |
| 3,705,716 | 12/1972 | Hendrickson | 266/22 |
| 3,875,032 | 4/1975 | Thompson | 204/109 |
| 3,925,184 | 12/1975 | Cave | 204/229 |
| 3,959,110 | 5/1976 | Burgess | 204/229 |
| 4,009,091 | 2/1977 | Washington | 204/228 |
| 4,018,658 | 4/1977 | Alfin | 204/109 |
| 4,026,784 | 5/1977 | Rivers | 204/273 |

OTHER PUBLICATIONS

Instrumental Methods of Chemical Analysis, Ewing, G. W. 1960, pp. 225-229.

How to Use Pulse Plating to Obtain High Quality Precious Metal Deposits, Insulation/Circuits, Jan. 1977.

The Electrodeposition of Gold by Pulse Plating, Gold Bulletin, Apr. 1977.

*Primary Examiner*—T. M. Tufariello

*Attorney, Agent, or Firm*—Jones, Thomas & Askew

[57] ABSTRACT

A silver recovery apparatus for recovering silver from a solution containing silver ions, such as a photographic fixer bath, including an electrolytic recovery cell, a probe electrode located in a liquid conduit connecting a source of the solution to the cell, and a magnetic drive pump in the same liquid conduit between the probe electrode and the cell. The probe electrode senses the presence or absence of silver ions at the cathode of the cell and provides a signal that is used to regulate a pulsed plating current. The relative orientation of the probe electrode, magnetic drive pump and recovery cell, as well as the pulsation of the plating current, results in higher plating currents in the cell at high silver ion concentrations.

5 Claims, 3 Drawing Figures

SILVER RECOVERY APPARATUS

TECHNICAL FIELD

The present invention relates to the recovery of metallic silver from solutions of silver ions such as fixer solutions used in photographic processing.

BACKGROUND ART

In the processing of X-ray and photographic films, fixer baths are used to remove silver halides from the film, and such silver compounds remain in solution in the fixer. The desirability of recovering the silver ions present in fixer solutions has long been recognized, both because of the value of the silver and because removal thereof revitalizes the fixer chemicals. The preferred method of recovering silver ions from a solution is by using an electroplating cell because, if operated correctly, an electroplating cell can recover silver of high purity.

Automatic control of the plating current in silver recovery cells has proved to be a significant problem, because photographic fixer solutions also include thiosulfate ions which, if electrolytically decomposed, form sulfides that damage the deposited silver and ruin the fixer solution. If the plating current is accurately controlled, silver can be plated without decomposing thiosulfate ions because silver ions will accept electrons at the cathode of the cell and form metallic silver at a lower threshold voltage (decomposition potential) than that necessary to decompose the thiosulfate. However, when a plating current is driven between the electrodes of a plating cell in the presence of silver ions, the concentration of silver ions drops as the ions are removed by plating, and as the concentration drops, the threshold voltage rises, until it approaches the threshold voltage for decomposing the thiosulfates. It is recognized in the art that the voltage across the electrodes must be maintained at a value below the threshold voltage for decomposing the thiosulfates.

One type of automatic control for a silver recovery system is disclosed in U.S. Pat. No. 3,551,318. In that system, a small reference electrolytic cell having its own anode and cathode is inserted into the solution within the plating cell at a selected location. The reference cell acts as a battery, and provides a voltage which drops when silver ions are introduced into the solution. The amount of voltage drop across the reference cell is used to control the main plating current by selecting the characteristics of a control circuit to cut off the plating current when the voltage across the reference cell rises above a predetermined value. The predetermined cut-off voltage must be arrived at by calculation or experimentation. One disadvantage of such a system is the possibility of contamination of the reference cell electrodes, which can affect the accuracy of the relationship between the reference cell voltage and the concentration of silver ions in the solution. Other disadvantages are the measurement of the concentration of silver ions at an arbitrary point within the cell rather than at the critical location adjacent to the cathodic plating surface, and the reliance on a calculated or experimentally determined fixed reference voltage at which the main plating current should be cut off.

Another type of silver recovery control is disclosed in U.S. Pat. No. 3,875,032. That system uses an auxillary anode and cathode to monitor the amount of current that will flow through a solution between the auxillary electrodes at a fixed reference voltage that is selected to be close to the threshold voltage for decomposing thiosulfates when no silver is present in the solution. The plating current is then controlled by a control circuit as a function of the measured current flowing between the auxillary electrodes. That is, when the measured current indicates that the threshold voltage for plating silver is becoming dangerously high, the plating current is cut off.

The system of U.S. Pat. No. 3,875,032 has disadvantages that are similar to the system first described. The concentration of silver ions is measured at a point remote from the actual plating surface and the measured concentration may vary from the concentration at the plating surface. Again, the system relies on calculated curves for determining the plating current cut-off point.

Laboratory electrodeposition techniques using controlled potential electrodes have been used to separate metal ions having relatively close decomposition potentials. In this method, any difference in the potential of a calomel reference electrode and the cathode is measured and used to increase or decrease the voltage driving the electrolysis current to maintain the cathode at the correct potential to carry out the desired deposition without undesirable decomposition.

No previous application of the controlled potential electrode technique to silver recovery from photographic chemical baths is known. We have found that the use of such technique without the modifications of the present invention fails to provide a desired efficiency of silver collection at concentrations of silver ions in solution above about 0.1 grams per liter, because the plating current is not permitted to rise to high enough values. It is believed that the continuous flow of plating current interferes with the ability of the reference electrode to accurately reflect higher silver ion concentrations that can support a relatively high plating current.

SUMMARY OF THE INVENTION

The present invention provides a means for increasing plating current efficiency at high silver ion concentrations when using a silver recovery system of the controlled potential electrode type. It has been found that use of a magnetic drive collector pump and placement of such pump between a probe electrode and a recovery cell causes higher plating currents to flow through the recovery cell at high silver ion concentrations. The reason for this unexpected result is not fully understood. It has also been found that pulsing the plating current, as in a 'sample and run' system, rather than driving a continuous flow of current, increases the amount of plating current that can be driven through the solution at high silver ion concentrations.

Generally described, the invention provides improvements in an apparatus for recovering silver from a solution containing silver ions, the apparatus including a recovery cell having a cathode and an anode, a receptacle containing the solution, and liquid conduit means connecting the receptacle and the cell. One improvement comprises probe means in contact with the solution in the liquid conduit means for providing a signal in response to presence of silver ions in the solution adjacent to the cathode, a means for repeatedly driving a plating current through the solution in the cell between the anode and the cathode in response to the signal, and magnetic drive pump means located between the probe and the cell for pumping the solution between the receptacle and the cell.

The other improvement comprises probe means in contact with the solution for providing a signal in response to presence of silver ions in the solution adjacent to the cathode, and means for repeatedly driving a plating current through the solution in response to the signal and for terminating the plating current after a discrete period of time, until the probe means again provides the signal in response to presence of silver ions adjacent to the cathode.

Each of such improvements unexpectedly increases plating efficiency at relatively high silver ion concentrations between about 0.1 and 1.0 grams per liter. Furthermore, when both such improvements are incorporated in a silver recovery system, the efficiency of silver recovery is increased by approximately a factor of ten at higher silver ion concentrations.

The method of recovering silver according to the invention comprises the steps of (a) introducing a solution of silver ions into an electroplating cell having an anode and a cathode, (b) monitoring the presence or absence of silver ions adjacent to the cathode, (c) responsive to presence of silver ions adjacent to the cathode, applying a plating potential across the anode and cathode to drive a plating current therebetween for a discrete period of time, and (d) alternately repeating steps (b) and (c).

Thus, it is an object of the present invention to provide a silver recovery apparatus and method for silver collection at extremely low silver ion concentrations without danger of decomposing undesirable ions and at high silver ion concentrations with high efficiency.

It is a further object of the present invention to provide a silver recovery apparatus that utilizes a probe electrode to directly measure the presence or absence of silver ions at the plating surface, and includes a magnetic drive pump in the liquid circuit between the probe and the plating surface.

It is a further object of the present invention to provide a method and apparatus for silver recovery utilizing a pulsed plating current in a recovery cell in connection with a probe electrode that provides a direct measurement of the presence or absence of silver ions at the plating surface.

Other objects, features and advantages of the present invention will become apparent upon reading the following specification, when taken in conjunction with the drawing and the appended claims.

DETAILED DESCRIPTION

Figure 1:
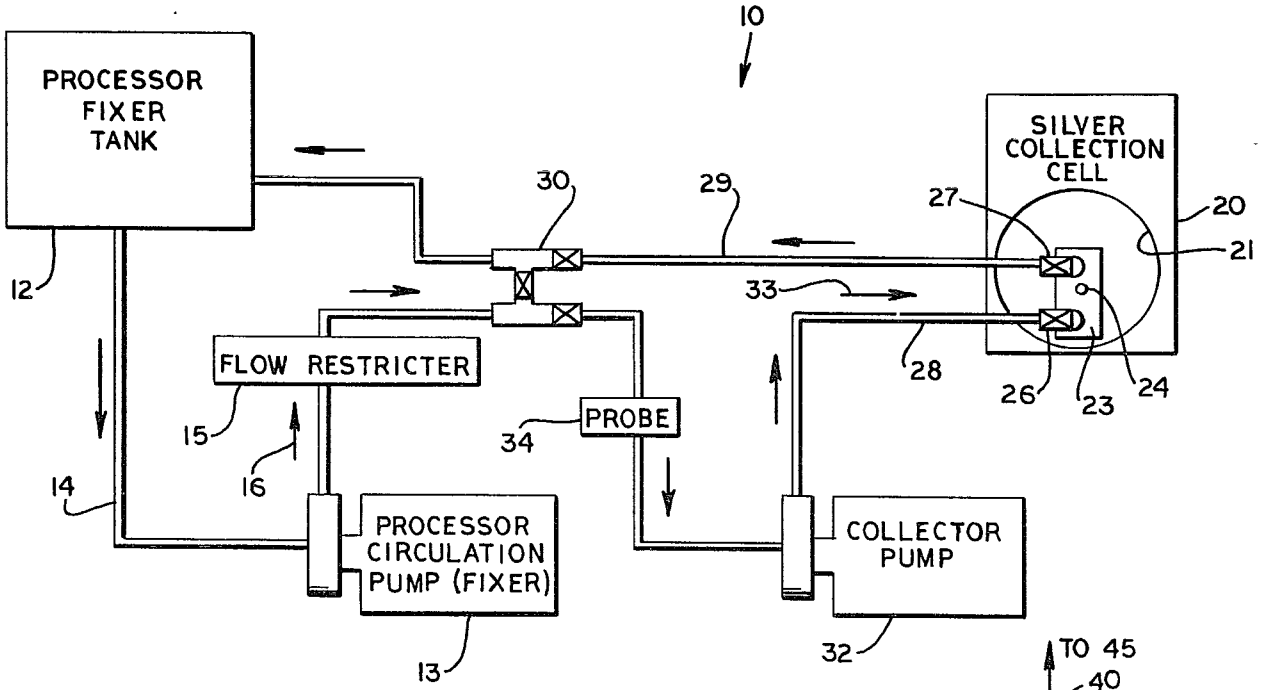
FIG. 1 is a schematic diagram of a silver recovery system embodying the present invention.

Referring now to the drawing, in which like numerals represent like parts throughout the several views, FIG. 1 shows a schematic diagram of a silver recovery system 10 embodying the present invention. The silver recovery apparatus 10 is used in conjunction with a photographic processor including a processor fixer tank 12 which holds the fixer bath chemicals that remove silver halides from X-ray or photographic film. In film processing, the fixer chemicals are circulated through liquid conduit 14 by a processor circulation pump 13 in the direction shown by the arrows 16. A conventional flow restrictor 15 is provided in the conduit 14.

The silver recovery apparatus 10 includes an electrolytic silver collection cell 20 shown in a diagrammatic top view in FIG. 1. The cell 20 includes a cylindrical cathode or cathodic plating surface 21 which defines the sidewall of the cell in addition to serving as the cathode. A support block 23 is mounted over the cell. Suspended therefrom and extending downwardly into the center portion of the cell is an anode 24. The cathode preferably consists of stainless steel, and the anode preferably consists of stainless steel rod having a titanium adaptor removably attached to the end thereof, although other suitable materials may be utilized for these electrodes. The support block 23 also provides a mounting for a liquid input valve 26 and an output valve 27 for connection to an input conduit 28 and an output conduit 29, respectively, through which fixer chemicals can be delivered from the fixer tank 12 to the cell 20 or recirculated by means of a bypass valve 30 which separates the processor conduit 14 from the recovery apparatus conduits 28 and 29. A collector pump 32 is located in the input conduit 28, and is preferably a magnetic drive pump. The collector pump pumps the fixer solution through the input conduit 28, the cell 20, and the output conduit 29 in the direction of the arrows 33. Also located in the input conduit 28 upstream of the collector pump 32, is a probe electrode 34 which extends into the liquid flow within the conduit.

The solution within the cell 20 is continuously agitated by a conventional agitator means, not shown.

Figure 2:
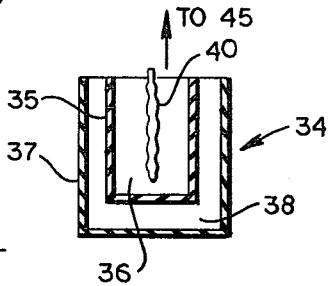
FIG. 2 is a diagrammatic cross-sectional view of a probe electrode for use with a silver recovery system as shown in FIG. 1.

The probe electrode 34 is shown diagramically in FIG. 2, and is preferably a Lazaran electrode of the type manufactured by Beckman Instruments Corporation. As shown in FIG. 2, the probe electrode 34 includes an inner chamber 35 containing a solution of potassium chloride 36, and an outer chamber 37 containing a solution of potassium nitrate 38. The walls of the chambers 35 and 37 comprise microporous material such as hydrolized Teflon, which permits electrons to pass through the material, but not ions of an adjacent solution. Extending into the inner chamber 35 is a lead 40 comprising a silver wire onto which silver chloride has been deposited. Alternately, a pH or calomel electrode of conventional construction can be utilized, but does not have the long life that is a characteristic of the preferred probe electrode. The probe 34 must provide a highly stable output and a high sensitivity to slight changes in the potential of the reference circuit to be described hereinbelow.

Figure 3:
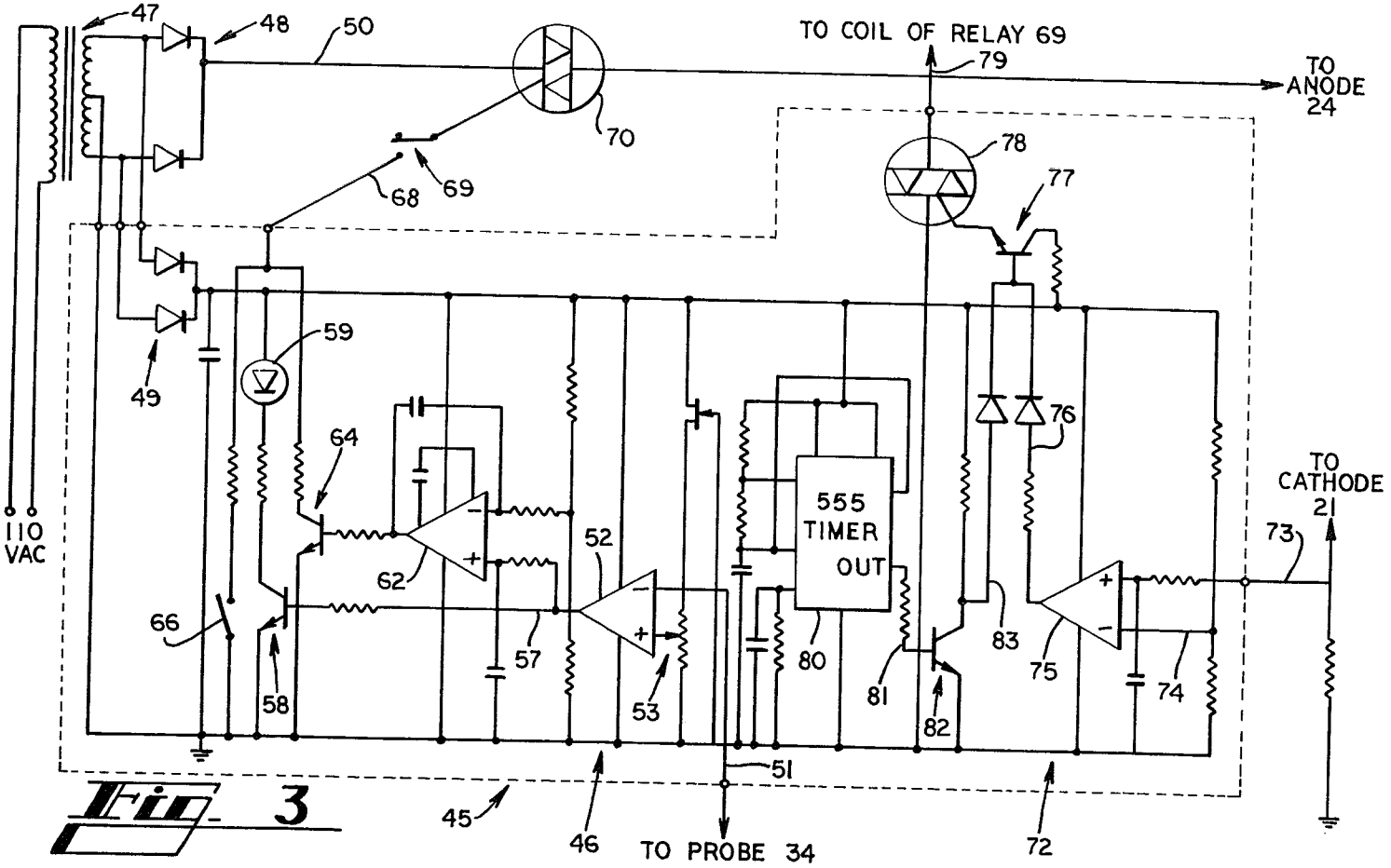
FIG. 3 is a schematic circuit diagram of a control circuit used to operate a silver recovery system as shown in FIG. 1.

FIG. 3 shows a control circuit 45 which provides a plating current circuit between the anode 24 and the cathode 21, and also provides a reference circuit 46 between the probe 34 and the cathode 21. An outside power line at 110 volts AC is stepped down by a main line transformer 47, which provides output of approximately six volts at up to twelve amps, and is converted to DC by a plating rectifier 48 and a reference circuit rectifier 49. When the plating current circuit is switched on, the current flows through a line 50 to the anode 24, and thereafter through the solution to the cathode 21, which is grounded.

In the reference circuit 46, the lead 40 of the probe 34 is connected by a line 51 to the negative input of a comparator 52. In the preferred embodiment comparator 52 comprises an operational amplifier with no feedback network. In the preferred embodiment shown in FIG. 3, all comparators are constructed from type CA3 (30 BiMOS) circuits currently manufactured by RCA but other comparators or amplifiers may be used. The positive input of the comparator 52 is connected to a potentiometer 53 that is used to adjust the voltage at the positive input of the comparator 52. The output of the comparator 52 is connected by a line 57 to the base of a transistor 58 which controls an LED 59. The output of the comparator 52 is also connected to the non-inverting input of an op-amp comparator 62, the output of which is connected to a transistor 64 and thence along a line 68 through a relay contact 69 to the gate of a triac 70 in the plating current line 50. As may be seen from FIG. 3 the comparator driving transistor 64 comprises on operational amplifier having a constant voltage from a voltage divider on its inverting input and capacitive negative fedback to provide a smoothing function. A manual overide switch 66 is also provided to bypass the transistor 64 if desired.

The control circuit 45 also includes a low current cut-off circuit 72 for inactivating the silver recovery apparatus 10 for substantial intervals when the plating current becomes very small because of low silver ion concentration. A line 73 connects the cathode 21 to a comparator 75 at the positive input thereof. The negative input of the comparator 75 is connected to a voltage divider by line 74 and therefore carries a constant voltage. The output of the comparator 75 is connected along a line 76 to a transistor 77, and thence to the gate of a triac 78. The main terminals of triac 78 are connected to ground and along line 79 to the coil (not shown) of the relay 69. The coil is normally energized and the relay contacts 69 closed unless the triac 78 is fired to cut off power to the relay coil. The circuit 72 also includes a continuously running timer 80, the output of which is also connected to the transistor 77 through a line 81, a transistor 82 and a line 83. As will be appreciated by those skilled in the art, timer 80 may be embodied by a conventional type 555 integrated circuit timer with external components arranged to form an astable multivibrator.

In operation of the silver recovery apparatus 10, new fixer chemicals are placed in the fixer tank 12 and pumped through the collection cell 20 by the pumps 13 and 32. The control circuit 45 is energized so that power is supplied to the comparator 52, and the other elements of the circuit 45.

It should be noted that the probe 34, when inserted into the solution, acts in the reference circuit 46 like a battery with a very high internal impedance. Therefore when any load is placed in the reference circuit, the probe 34 attempts to compensate for the load and immediately drops in voltage because the probe is incapable of compensating for the load. In the apparatus 10, the load is provided when an ion in the fixer solution disassociates from the solution and accepts electrons from the cathode, which occurs when the reference circuit is at a voltage above the threshold voltage for the particular ion. Therefore, before silver ions are introduced into the fixer solution, the potentiometer 53 is adjusted or "zeroed out" until the reference voltage across the reference circuit is just below the threshold voltage at which any non-silver ions in the new fixer solution would disassociate or decompose. This is accomplished first by raising the reference voltage until the LED 59 comes on, indicating that ions are plating at the cathode 21, and then by lowering the reference voltage until the LED 59 turns off. Since the threshold voltage for silver ions is lower than that for the other ions in the solution, silver ions which are introduced into the solution and approach the plating surface of the cathode will disassociate at the set reference voltage.

Thus, as the apparatus is placed in operation and silver halides are introduced into the fixer solution, the silver ions approach the cathode 21 and plate onto the cathode. The change in voltage at the cathode caused by the plating of silver ions is sensed by the probe 34 which attempts to compensate for the change in voltage through the reference circuit 46. The resulting drop in the output voltage of the probe 34 is input to the comparator 52 along the line 51. When such voltage falls below the reference voltage provided to the comparator by the potentiometer 53, the output of the comparator goes high. The high output of the comparator 52 is filtered and smoothed by the comparator 62 and turns on the transistor 64. Unless the circuit 72 has fired the triac 78, the relay 69 is energized and its contacts closed, so that when the transistor 64 is turned on, the triac 70 is fired and plating current flows through the line 50 and between the anode 24 and the cathode 21 in the cell 20 for the remainder of the half cycle in which the triac 70 is energized. The surge of plating current depletes the supply of silver ions in the immediate vicinity of the cathode, so that when the triac 70 shuts the plating current off, the probe 34 may not see silver ions in the immediate vicinity of the plating surface and therefore the comparator 52 will switch back to its low state and will not go high again until the probe 34 again senses the presence of silver ions at the plating surface. It will be appreciated that triac 70 will cut off at the end of ech half cycle of the rectified output of rectifier 48 and will retrigger only if its gate terminal continues to receive a trigger signal from transistor 64. Thus, the plating current is driven in response to presence of silver ions adjacent to the cathode 21 for a discrete period of time and then cut off until the probe 34 again senses the presence of silver ions at the cathode.

It should be noted that the value of the plating current in amperes is not controlled as in prior art systems, but is permitted to float according to the concentration of silver ions present in the fixer solution. In the present system, the threshold voltage is, in effect, directly measured by the reference circuit. Plating current is passed through the cell 20 only when the threshold voltage is at an acceptable value, that is when, silver ions are available for plating immediately adjacent to the cathode 21.

The manual override switch 66 is provided so that the triac 70 can be fired continuously without regard to the sensing of silver ions by the probe 34, if desired.

As noted above, the low current cut-off circuit 72 comes into play when the plating current drops to a low value, typically about 1 ampere, which indicates that the concentration of silver ions in the fixer solution has dropped to about 0.05 grams per liter. Under these conditions, the system would have to operate for about eight hours in order to plate an ounce of metallic silver. Therefore, the circuit 72 shuts down the system for a set period of time in order to allow the silver concentration to build up to a point where the plating current can be efficiently operated. The timer 80 operates continuously on a two minute on (line 81 low) twenty minute off (line 81 high) cycle so that the output on line 81 has a duty cycle of approximately 0.91. An indication of the amount of plating current in the plating circuit is transmitted to the comparator 75 by the line 73, so that the voltage at the positive input to the comparator 75 drops as the plating current value drops. The comparator 75 goes low when the input along line 73 drops below the constant voltage input along line 74. Under such conditions, the low output along line 76 turns off the transistor 77 (unless transistor 82 is off), causing the triac 78 to deenergize the coils of the relay 69, breaking the circuit along the line 68 so that the response of the comparator 52 to the probe 34 cannot fire the triac 70 to connect the plating current along the line 50 to the anode 24.

Thus, it will be seen that when the plating current is sufficiently low that the output along line 76 from the comparator 75 is low, firing of the triac 70 will be enabled only during the two minute "on" cycle of the timer 80. During such two minute "on" cycles the probe 34 will operate in a normal fashion to provide plating current as required by the presence of silver ions at the plating surface. However, if the concentration of silver ions increases so that the output of the comparator 75 remains high, the high output along line 76 will override the timer 80 and continuously energize the relay 69 and enable the triac 70 until the concentration of silver ions is again reduced to a value which causes the output along line 76 to go low.

In addition to the advantages of the apparatus 10 according to the present invention of independence from indirect calculations based upon measurements of silver ion concentration at points remote from the plating surface, the apparatus 10 also has the advantage of increased sensitivity and control of the threshold voltage, so that a greater percentage of the silver ions in fixer solutions can be removed without danger of contamination by decomposition of undesirable ions. This not only provides the monetary value of the additional recovered silver, but also protects the environment by removing more of the toxic silver ions from waste water. Also, the lifetime of the fixer bath is extended, as is the archival life of the film processed using the fixer chemicals.

As noted above, it has been found that the use of a magnetic drive pump 32 and the placement thereof in the liquid conduit 28 between the probe electrode 34 and the cell 20 has the unexpected result of increasing the plating current passing between the anode 24 and the cathode 21 when there is a relatively high concentration of silver ions in the fixer solution. It is believed that the magnetic pump shields the probe from adverse effects of the plating current.

Also, efficiency at high silver ion concentrations is increased by using the triac 70 to pulse the plating current in response to the signal provided by the probe 34. When the triac 70 is fired, voltage is applied across the anode 24 and the cathode 21 for a short period of varying length not greater than the remainder of the half cycle of the rectified output of rectifier 48 during which the triac 70 is triggered. Then the plating current is cut off, allowing the probe 34 to sense whether silver ions again become present adjacent to the cathode 21 without interference from the plating current. This is important at high silver ion concentrations because the accuracy of the probe 34 as described above decreases with increased silver ion concentration. The pulsation of the plating current is also believed to increase the rate of migration of silver ions to positions adjacent to the cathode. This permits the plating voltage to drive a larger average current.

The preferred embodiment of the invention includes both the placement of a magnetic pump between the probe electrode and the cathode and circuit means for pulsing of the plating current in cooperation with the output of the probe electrode. It has been found that plating current values at high silver ion concentrations using the preferred embodiment are about ten times higher than is possible using a conventional probe electrode placement and a continuous DC plating current. It will be understood that collection of ions other than silver can be facilitated using the concepts of the present invention.

While this invention has been described in detail with particular reference to preferred embodiments thereof, it will be understood that variations and modifications can be effected within the spirit and scope of the invention as described hereinbefore and as defined in the appended claims.

We claim:

1. An apparatus for recovering a particular ion from a solution containing a plurality of ions of differing decomposition potential, said particular ion having the lowest decomposition potential of said plurality of ions, comprising:

a recovery cell having a positive electrode and a negative electrode;

a receptacle containing said solution;

liquid conduit means connecting said receptacle and said cell;

probe means in contact with said solution in said liquid conduit means for providing a signal in response to presence of said particular ion in said solution adjacent to the one of said electrodes of opposite polarity to said particular ion;

magnetic drive pump means located between said probe means and said cell for pumping said solution between said receptacle and said cell; and means for repeatedly driving a plating current through said solution in said cell between said electrodes in response to said signal and terminating said plating current after a discrete period of time, until said probe means again provides said signal.

2. The apparatus of claim 1 wherein said solution comprises photographic fixer solution and wherein said particular ion is silver.

3. An apparatus for recovering a particular ion from a solution containing a plurality of ions of differing decomposition potential, said particular ion having the lowest decomposition potential of said plurality of ions, comprising:

a recovery cell having a positive electrode and a negative electrode;

a receptacle containing said solution;

liquid conduit means connecting said receptacle and said cell:

probe means in contact with said solution in said liquid conduit means for providing a signal in response to presence of said particular ion in said solution adjacent to the one of said electrodes of opposite polarity to said particular ion;

means for driving a plating current through said solution in said cell between said electrodes in response to said signal; and magnetic drive pump means located between said probe means and said cell for pumping said solution between said receptacle and said cell.

4. An apparatus for recovering a particular ion from a solution containing a plurality or ions of differing decomposition potential, said particular ion having the lowest decomposition potential of said plurality of ions, comprising:

a recovery cell including a positive electrode and a negative electrode and containing said solution;

single-electrode probe means, of the same polarity as said particular ion, in contact with said solution for providing a signal in response to presence of said particular ion adjacent to the one of said electrodes of opposite polarity to said particular ion;

means for driving a plating current between said positive and negative electrodes; and control means for (a) operating said plating current driving means in response to presence of said signal from said probe means, (b) terminating operation of said plating current driving means after a discrete period of time, (c) determining the presence or absence of said signal from said probe means while no plating current is being driven, and (d) responsive to presence of said signal from said probe means, operating said plating current driving means.

5. The apparatus of claim 4 further comprising means for agitating said solution in said recovery cell.

* * * * *